US010238264B2

(12) United States Patent
Rueckheim et al.

(10) Patent No.: US 10,238,264 B2
(45) Date of Patent: Mar. 26, 2019

(54) TORSION WRINGER HAVING LITTLE TRAVEL

(71) Applicant: Carl Freudenberg KG, Weinheim (DE)

(72) Inventors: Markus Rueckheim, Griesheim (DE); Christian Mast, Mannheim (DE); Norbert Weis, Weinheim (DE); Uwe Dingert, Absteinach (DE); Reiner Wallbaum, Duesseldorf (DE); Johannes Hohenhaus, Willich (DE)

(73) Assignee: CARL FREUDENBERG KG, Weinheim (DE)

( * ) Notice: Subject to any disclaimer, the term of this patent is extended or adjusted under 35 U.S.C. 154(b) by 0 days.

(21) Appl. No.: 15/572,177

(22) PCT Filed: Mar. 18, 2016

(86) PCT No.: PCT/EP2016/056011
§ 371 (c)(1),
(2) Date: Nov. 7, 2017

(87) PCT Pub. No.: WO2016/180561
PCT Pub. Date: Nov. 17, 2016

(65) Prior Publication Data

US 2018/0103821 A1 Apr. 19, 2018

(30) Foreign Application Priority Data

May 12, 2015 (DE) ..... 10 2015 005 948

(51) Int. Cl.
*A47L 13/58* (2006.01)
*A47L 13/59* (2006.01)
*A47L 13/258* (2006.01)

(52) U.S. Cl.
CPC ..... *A47L 13/59* (2013.01); *A47L 13/58* (2013.01); *A47L 13/258* (2013.01)

(58) Field of Classification Search
CPC ..... A47L 13/58; A47L 13/59; A47L 13/258
See application file for complete search history.

(56) References Cited

U.S. PATENT DOCUMENTS 1,886,184 A * 11/1932 Heber ..... A47L 13/58 15/263
5,727,281 A * 3/1998 Harper ..... A47L 13/14 15/260

(Continued)

FOREIGN PATENT DOCUMENTS

CN 103720451 A 4/2014
DE 102006045615 B3 10/2007

(Continued)

*Primary Examiner* — Michael Jennings
(74) *Attorney, Agent, or Firm* — Leydig, Voit & Mayer, Ltd.

(57) ABSTRACT

In an embodiment, the present invention provides a torsion wringer including: a contraction device for receiving a mop head of a mop, the contraction device having an upper part and a lower base which are interconnected by contraction lamellae, the contraction lamellae being hinged to the upper part and to the lower base such that the upper part can rotate relative to the lower base, the contraction device being movable relative to a carrier device over a distance of travel, as a result of which the upper part rotates through an angle of rotation relative to the carrier device and relative to the lower base. A reduction unit is provided so as to reduce a force which counteracts the rotation of the upper part.

20 Claims, 10 Drawing Sheets

(56) References Cited

U.S. PATENT DOCUMENTS

| | | | | |
|---|---|---|---|---|
| 6,684,450 | B2 * | 2/2004 | Dingert | A47L 13/58 15/260 |
| 6,823,557 | B2 | 11/2004 | Dingert | |
| 7,197,787 | B2 * | 4/2007 | Sehestedt | A47L 13/58 15/260 |
| 9,161,673 | B2 * | 10/2015 | Tronconi | A47L 13/58 |
| 2007/0094834 | A1 * | 5/2007 | Gil | A47L 13/59 15/261 |
| 2009/0288266 | A1 * | 11/2009 | Dingert | A47L 13/58 15/260 |
| 2015/0282689 | A1 * | 10/2015 | Ngan | A47J 47/18 15/260 |
| 2016/0183760 | A1 | 6/2016 | Weis et al. | |

FOREIGN PATENT DOCUMENTS

| | | | | |
|---|---|---|---|---|
| EP | 0898927 | A1 | 3/1999 | |
| WO | WO 2014022888 | A1 * | 2/2014 | A47J 47/18 |
| WO | WO 2015024611 | A1 | 2/2015 | |

* cited by examiner

D-D

C-C

TORSION WRINGER HAVING LITTLE TRAVEL

CROSS-REFERENCE TO PRIOR APPLICATIONS

This application is a U.S. National Phase application under 35 U.S.C. § 371 of International Application No. PCT/EP2016/056011, filed on Mar. 18, 2016, and claims benefit to German Patent Application No. DE 10 2015 005 948.3, filed on May 12, 2015. The International Application was published in German on Nov. 17, 2016 as WO 2016/180561 under PCT Article 21(2).

FIELD

The invention relates to a torsion wringer.

BACKGROUND

The prior art describes removing liquid from the mop head of a mop by squeezing it out. WO 2015/024 611 A1 discloses a torsion wringer which can be used to carry out such a squeezing process. The mop head is inserted into a space in a contraction device and freed from liquid by being squeezed out. For this purpose, the user exerts a downwardly directed force on the contraction device. The easiest way to do this is to transfer weight onto the handle of the mop.

When the base of the contraction device is pushed downwards by the mop head of the mop, the entire contraction device is carried therewith and rotated, at least in regions, with respect to a carrier device. The rotation reduces the size of the space in the contraction device. This results in the mop head being wrung out.

It is often necessary, however, for the mop head to cover a relatively long distance of travel in order for parts of the contraction device to move through a sufficiently large angle of rotation. It is often required that there be a sufficiently large angle of rotation so that means for squeezing out the mop head are able to apply a sufficiently large force to said mop head and to wring out said mop head.

In this process, a large angle of rotation can be achieved by a thread or guide being highly inclined. In turn, however, this results in a long distance of travel. This results in a torsion wringer having high overall heights. High overall heights lead to high costs.

SUMMARY

In an embodiment, the present invention provides a torsion wringer comprising: a contraction device configured to receive a mop head of a mop, the contraction device having an upper part and a lower base which are interconnected by contraction lamellae, the contraction lamellae being hinged to the upper part and to the lower base such that the upper part can rotate relative to the lower base, the contraction device being movable relative to a carrier device over a distance of travel, as a result of which the upper part rotates through an angle of rotation relative to the carrier device and relative to the lower base, wherein a reduction unit is provided so as to reduce a force which counteracts the rotation of the upper part.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
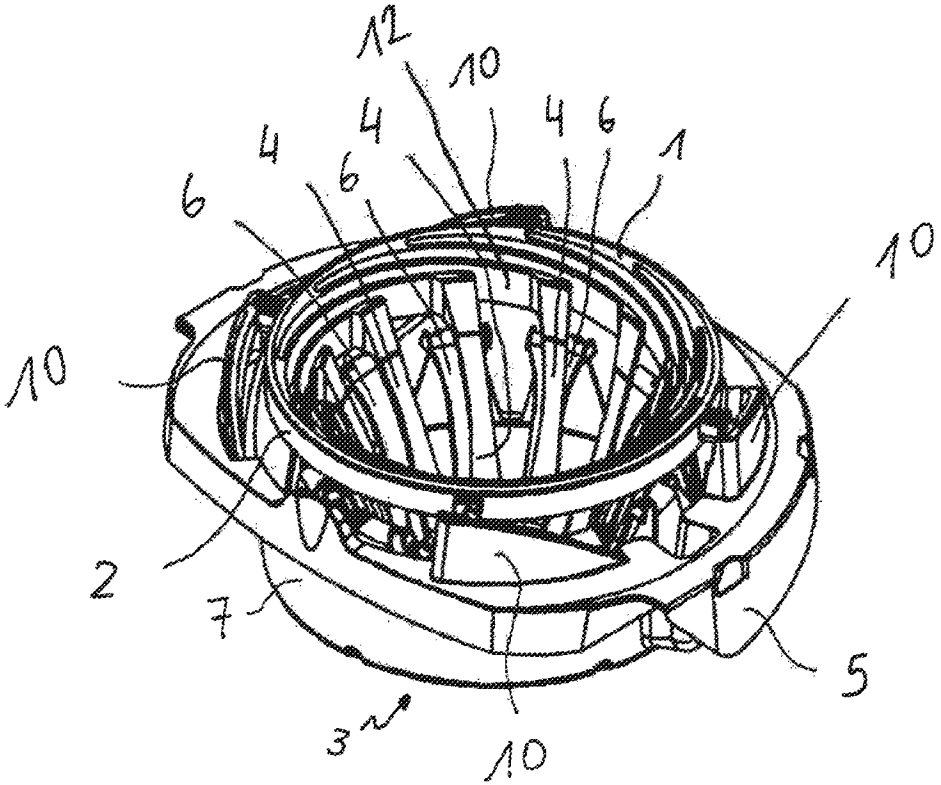
FIG. 1 is a perspective view of a torsion wringer which can be inserted into a bucket as a module, the module comprising two components, namely a carrier device, which comprises spring lamellae acting as return elements, and a contraction device, which comprises contraction lamellae.

A torsion wringer according to the invention comprises a contraction device and a carrier device. It is possible to produce a strong wringing-out action when the distance of travel covered by the mop head is short. When assembled together to form a module, the contraction device and the carrier device have a relatively low overall height. A strong wringing-out action can still be produced with little travel. This is solved according to the invention by a reduction unit being used to significantly reduce the occurrences of friction, catching and self-locking of an upper part of the contraction device on the carrier device.

Specifically, the invention recognizes that a normal force and/or a coefficient of static friction, acting as factors of a static friction force, have to be reduced in order to reduce occurrences of self-locking of the upper part on the carrier device. The reason is that the upper part is supported against the carrier device at a normal force when the contraction device is pushed downwards by a reciprocating force. The normal force counteracts, together with the coefficient of friction, rotation of the upper part. As a result of a reduction in the normal force, rotation is made easier by a force which counteracts said rotation being reduced. It has also been recognized that the coefficient of friction can be appropriately modified so as to facilitate rotation by a suitable choice of materials, rollers or lubricants, in particular lubricant lacquers. Owing to the counter action of the reduction unit, the reciprocating force by means of which a mop is pushed into the contraction device is converted only to a lesser extent into the normal force against the carrier device of the upper part. Therefore, owing to the reduction unit, a lower frictional force counteracts the rotation of the contraction device. Therefore, a slight inclination in the guide of the upper part of the contraction device can function without difficulty. Furthermore, the reduction unit can counteract the pressure applied by the mop to be squeezed out, which pressure presses radially outwards onto the contraction lamellae, and can thus facilitate the desired rotation of the upper part of the contraction device. Therefore, the torsion wringer can be designed so as to be compact and cost-effective and so as to have a good wringing-out action.

This solves the problem mentioned at the outset.

The contraction device is preferably formed in one piece. The carrier device is preferably formed in one piece.

The distance of travel could be in the range of from 1 cm to 20 cm, preferably in the range of from 3 cm to 8 cm, particularly preferably in the range of from 3 cm to 5 cm, and the angle of rotation could be in the range of from 5° to 180°, preferably in the range of from 10° to 45°, particularly preferably in the range of from 25° to 35°.

Against this background, the reduction unit could comprise at least one spring element which is operatively connected to the contraction device such that said element pushes the contraction device into its starting position counter to the reciprocating force. As a result, once a mop head has been removed, the contraction device is always guided back into a starting position.

Spring lamellae, acting as a reduction unit, could be arranged on the carrier device, which spring lamellae push the contraction lamellae radially inwards when the contraction device is moved relative to the carrier device. The spring lamellae of the carrier device push, in the radial direction, against the contraction lamellae of the contraction device and force said contraction lamellae radially inwards while the contraction device is being pushed downwards. This further promotes the wringing-out and pressing effect of the contraction lamellae.

In the process, the inwardly pushing spring lamellae also reduce the pressure applied by the mop to be squeezed out, which pressure presses radially outwards onto the contraction lamellae and thus counteracts the desired rotation of the upper part of the contraction device.

At least one spring lamella could have a first leg which is hinged to a collar of the carrier device, a second leg being hinged to a support base of the carrier device. As a result of this design, the spring lamellae can produce a relatively strong and long-lasting restoring action. There is no need for a spring that acts on the base of the contraction device directly from below. Moreover, the carrier device and the contraction device can very easily be stacked, separately or together in each case. This reduces storage costs. In addition to a preferred V shape for the leg arrangement, W shapes, Z shapes, U shapes or other shapes in which at least two legs interact in a resilient manner are also conceivable.

At least one spring lamella could comprise at least one stop lug, preferably two or more stop lugs. Stop lugs could be arranged on either side of an upper region of a spring lamella, which stop lugs come into contact with stop lugs of the spring lamellae adjacent thereto in each case when the base of the carrier device is pushed downwards. This prevents a spring lamella from plastically extending too far, and thus ensures a smooth restoring action in the manner of a return spring.

A traction cable could be provided which is fastened at one end to a spring lamella or a support base of the carrier device and at the other end to a collar of the carrier device. Alternatively or additionally, a traction cable could be provided which could be arranged, at one end, on a lower region, a central region or an upper region of a spring lamella. The other end of the traction cable could be fastened to a collar of the carrier device, which collar concentrically surrounds the spring lamellae. When a spring lamella extends such that the stop lugs thereof come into abutment, the traction cable is located in the path region. This prevents the spring lamellae from plastically extending too far, and therefore a return motion is possible.

The contraction device could comprise on the upper part thereof guide cams which are in engagement with guides which are associated with the carrier device. Guides, preferably four guides, could be associated with an upper collar of the carrier device, which guides comprise grooves which extend obliquely from the top to the bottom. The contraction device comes into engagement with said grooves.

The guide cams could be movable in the guides or grooves in a manner in which they are mounted on rollers or wheels. This reduces frictional forces.

Against this background, a guide could comprise a curved or inclined groove in which a guide cam is guided. Preferably, the contraction device comprises an upper part on which guide cams are arranged which protrude radially in the manner of a star. The guide cams engage in the grooves in the guides. When the contraction device is pushed downwards, the guide cams cause the contraction device to be guided downwards.

The groove could be inclined with respect to the horizontal by a slot angle which is in the range of from 20° to 89°, preferably in the range of from 25° to 40°. This makes it possible to achieve a large angle of rotation with a short distance of travel.

The contraction lamellae could extend from an upper part of the contraction device to a base of the contraction device, a contraction lamella being hinged to the upper part by means of a pivot element, and the pivot element bending radially inwards when the upper part is moved relative to the carrier device and relative to the base of the contraction device. The pivot element is preferably designed as a curved portion in the shape of a circular segment. A contraction lamella is hinged to an upper part of the contraction device by means of a curved portion in the shape of a circular segment. The curved portion in the shape of a circular segment makes it possible for the contraction lamella to be movable radially inwards, with relatively little force, when the contraction device is moved downwards. The curved portion in the shape of a circular segment is bent radially inwards and the contraction lamella hinged thereto is thereby moved radially inwards to a greater extent in an upper region than in the lower region thereof. Forming curved portions in the shape of circular segments or forming other easily movable or bendable pivot elements requires less force than the wringing-out process from the prior art in order to produce the same wringing-out effect.

Moreover, when viewed from above, the rotation of the upper part of the contraction device relative to the base thereof can be seen clearly. The user can see that rotation is taking place because the upper part of the contraction device rotates not only relative to the base thereof, but also relative to the carrier device. When viewed from above, the gap between the curved portions in the shape of circular segments resembles the opening in the diaphragm of a camera. The curved portions in the shape of circular segments form a spiral-shaped structure.

The contraction lamellae could extend from an upper part of the contraction device to a base of the contraction device, the base remaining rotationally fixed when the upper part is moved relative to the carrier device. The base is substantially rotationally fixed when the contraction device is pushed downwards relative to the carrier device. When the contraction device is pushed downwards, the contraction lamellae are moved radially inwards. In this case, the base, on which the contraction lamellae end, remains rotationally fixed. The base only moves downwards and can be moved sideways to a slight extent.

The contraction lamellae could be arranged so as to be inclined with respect to a base of the contraction device, the contraction lamellae bending radially inwards in regions when the upper part is moved relative to the carrier device and relative to the base of the contraction device. Preferably, a contraction lamella is arranged so as to be inclined relative to the base of the contraction device, insofar as rotation has not yet taken place. Once the rotation has taken place, the contraction lamellae bend substantially orthogonally to the base such that the mop is gripped and squeezed by said lamellae. As a result, the mop head remains approximately elongate, and is pressed out more effectively. Water inside the mop head can be removed more effectively. In the lamella wringer according to DE 10 2006 045 615 B3, wringing out is performed such that the lamellae surround the head of the mop in the manner of a clamp and force the textiles thereof into a ball. However, in the torsion wringer described here the contraction lamellae only bend in the vertical direction and the textiles are thus pressed into a cylindrical shape.

It could be possible for the base of the contraction device to lock into a spring-mounted support base of the carrier device. This results in the carrier device being interlockingly connected to the contraction device.

A mounting device could be provided on the carrier device, by means of which mounting device the handle of a mop can be stably mounted. Preferably, the mounting device is designed as a concave recess in which the outer circumferential surface of the handle can be mounted such that it cannot tilt.

Support elements could be arranged on the carrier device which ensure that a bucket having a carrier device placed thereon is not deformed when it is pushed radially inwards in the lateral direction. The wall of the bucket can abut the support elements and rest against the carrier device.

A set could comprise a torsion wringer of the type described here and a bucket, the torsion wringer being interlockingly connected to the bucket. The carrier device is preferably securely clipped onto the edge of the bucket. A set could preferably comprise a torsion wringer of the type described here, a mop, in particular a strip mop, and a bucket. A strip mop can be gripped and wrung out by the contraction lamellae in a particularly effective manner.

The invention described here can be used by consumers, but also by professional cleaners.

FIG. 1 shows a torsion wringer comprising a contraction device 1 for receiving a mop head of a mop, the contraction device 1 having an upper part 2 and a lower base 3 which are interconnected by contraction lamellae 4, the contraction lamellae 4 being designed and/or hinged to the upper part 2 and to the base 3 such that the upper part 2 can rotate relative to the base 3, and it being possible for the contraction device 1 to be moved relative to a carrier device 5 over a distance of travel H, as a result of which the upper part 2 rotates through an angle of rotation T relative to the carrier device 5 and relative to the base 3.

The upper part 2 is designed as an annular element.

A force which counteracts the rotation of the upper part 2 is reduced by means of a reduction unit. A reduction unit is provided by means of which a force which counteracts the rotation of the upper part 2 can be reduced.

Figure 6:
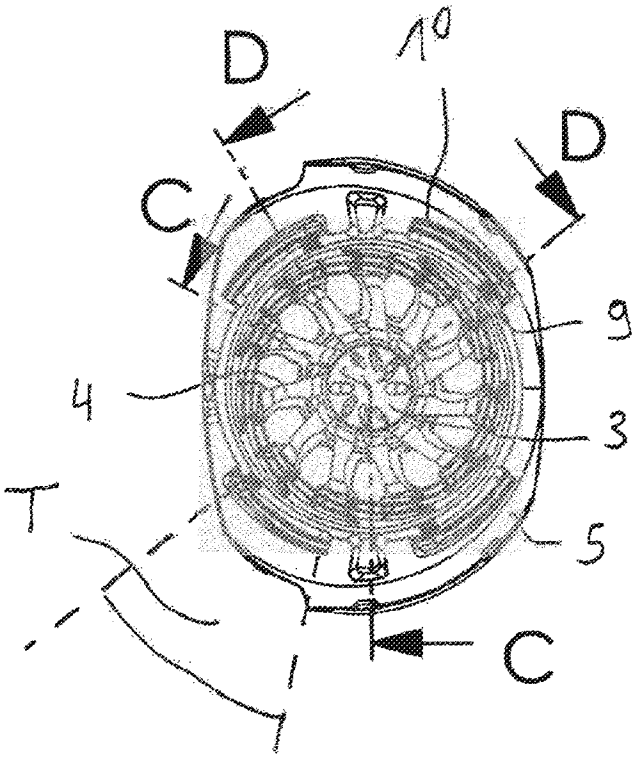
FIG. 6 is a plan view of the torsion wringer according to FIG. 1 from above, two sectional lines being shown.
Figure 8:
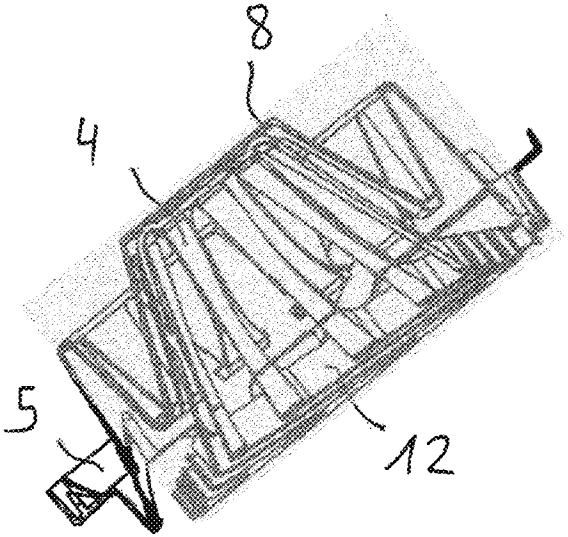
FIG. 8 is a view of the torsion wringer according to FIG. 1 along the sectional lines D-D.
Figure 7:
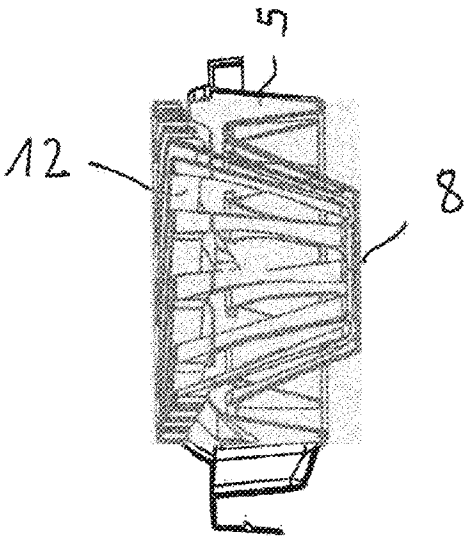
FIG. 7 is a view of the torsion wringer according to FIG. 1 along the sectional lines C-C.

The distance of travel H is 3.5 cm and the angle of rotation T is 30°. These variables are shown schematically in FIGS. 6 and 10.

At least one spring element, acting as a reduction unit, is operatively connected to the contraction device 1 such that said element pushes the contraction device 1 into its starting position counter to the reciprocating force.

Spring lamellae 6, acting as a reduction unit, are arranged on the carrier device 5, which spring lamellae push the contraction lamellae 4 radially inwards when the contraction device 1 is moved relative to the carrier device 5. Specifically, the spring lamellae 6 are, at the same time, spring elements.

Figure 10:
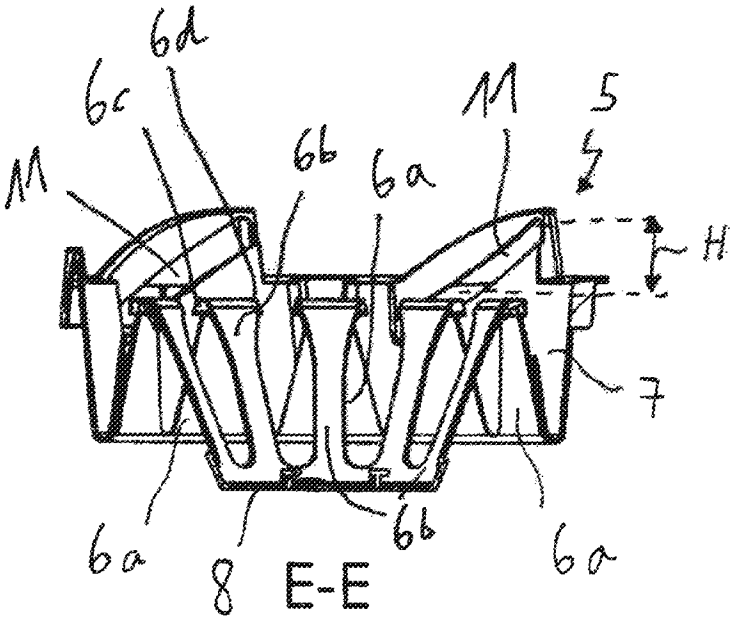
FIG. 10 is a view of the carrier device according to FIG. 1 along the sectional line E-E.
Figure 9:
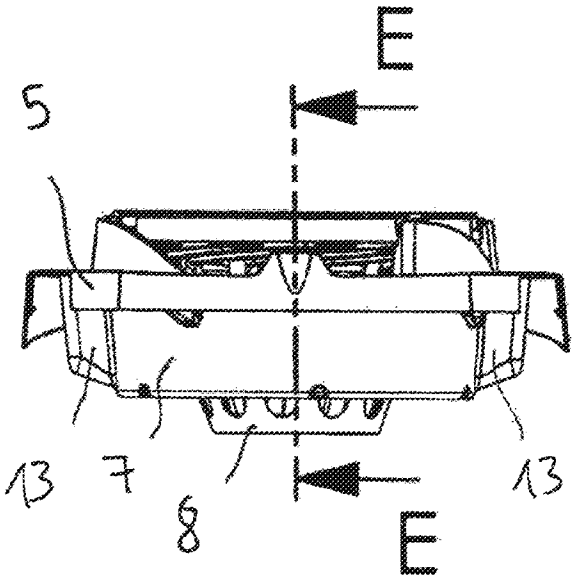
FIG. 9 is a plan view of the carrier device of the torsion wringer according to FIG. 1, one sectional line being shown.

FIG. 10 shows that at least one spring lamella 6 is V-shaped, a first leg 6*a* of the V being hinged to a collar 7 of the carrier device 5, and the second leg 6*b* being hinged to a support base 8 of the carrier device 5.

At least one spring lamella 6 comprises two stop lugs 6*c*, 6*d*.

Figure 2:
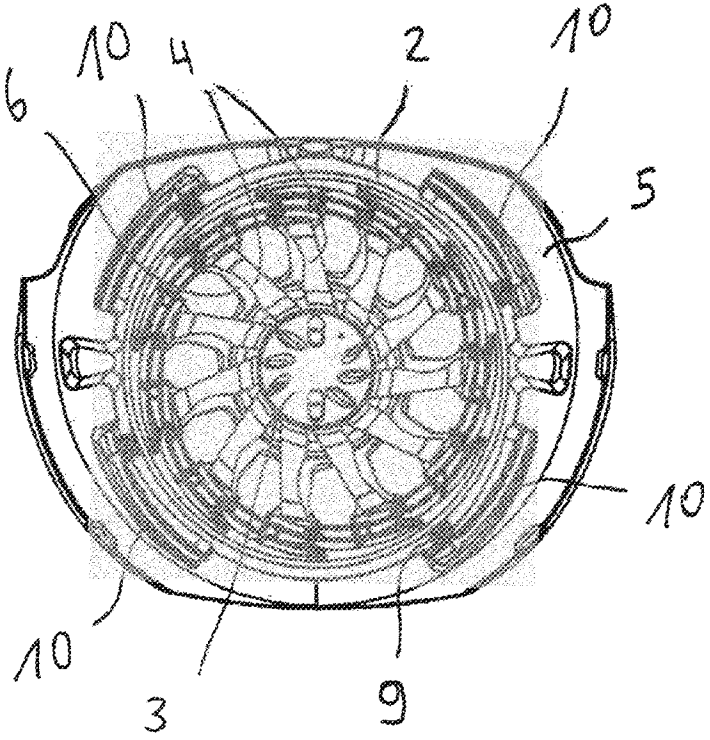
FIG. 2 is a plan view of the torsion wringer according to FIG. 1 from above.
Figure 3:
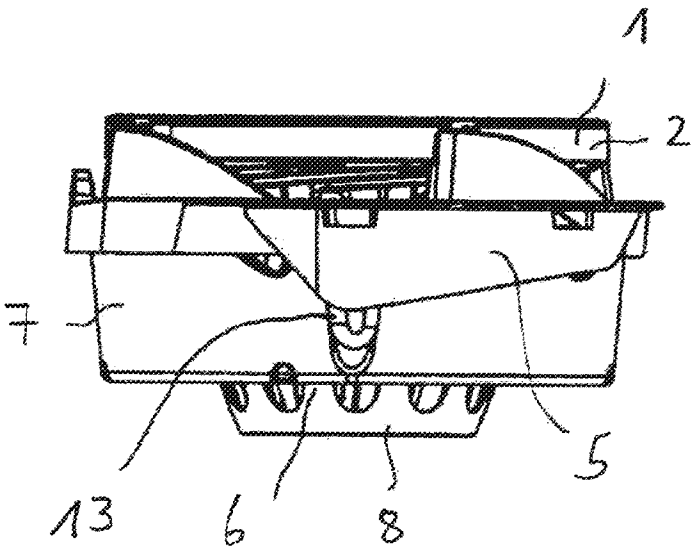
FIG. 3 is a side view of the torsion wringer according to FIG. 1.

The contraction device 1 comprises on the upper part 2 thereof guide cams 9. This can be seen clearly in FIG. 5. The guide cams 9 are in engagement with guides 10 which are associated with the carrier device 5. FIG. 2 shows that four guide cams 9 are provided.

Figure 4:
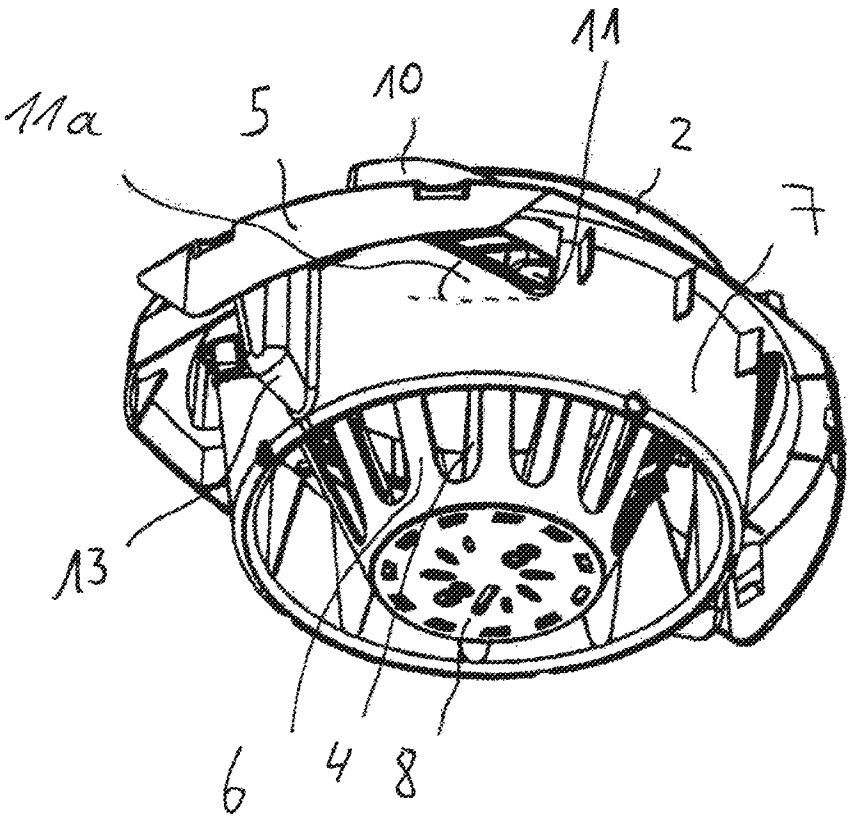
FIG. 4 is a perspective view from below of the torsion wringer according to FIG. 1.

FIG. 4 shows that a guide 10 comprises a curved or inclined groove 11 in which a guide cam 9 is guided. The groove 11 is inclined with respect to the horizontal by a slot angle 11*a* of 30.5°.

Figure 5:
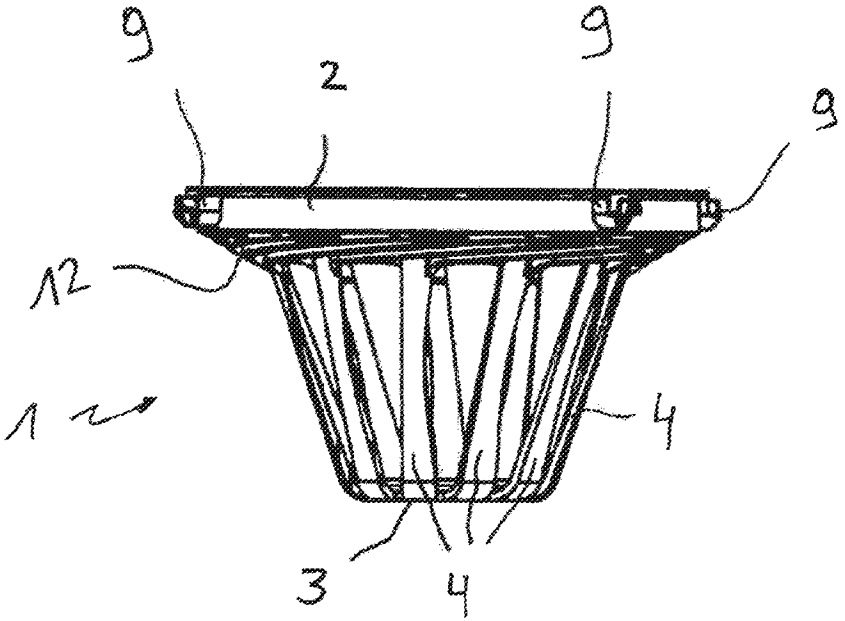
FIG. 5 is a side view of the contraction device of the torsion wringer according to FIG. 1, shown in isolation.

FIGS. 1 and 5 show that the contraction lamellae 4 extend from an upper part 2 of the contraction device 1 to a base 3 of the contraction device 1, a contraction lamella 4 being hinged to the upper part 2 by means of a curved portion 12 in the shape of a circular segment.

The curved portion 12 in the shape of a circular segment bends radially inwards when the upper part 2 is moved relative to the carrier device 5 and relative to the base 3. In this respect, the curved portion 12 in the shape of a circular segment is a pivot element.

The contraction lamellae 4 extend from an upper part 2 of the contraction device 1 to a base 3 of the contraction device 1, the base 3 remaining rotationally fixed when the upper part 2 is moved relative to the carrier device 5.

FIG. 5 shows that the contraction lamellae 4 are arranged so as to be inclined with respect to a base 3 of the contraction device 1. The inclination of the contraction lamellae 4 with respect to the base 3 decreases when the upper part 2 is moved relative to the carrier device 5. As a result of bending, the contraction lamellae 4 are oriented substantially orthogonally to the base 3 the further the contraction device 1 is pushed downwards.

The base 3 of the contraction device 1 can be locked into a spring-mounted support base 8 of the carrier device 5. The support base 8 is spring mounted with respect to the collar 7 of the carrier device 5 by means of the spring lamellae 6.

A mounting device is provided on the carrier device 5, by means of which mounting device the handle of a mop can be stably mounted.

Support elements 13 are arranged on the carrier device 5 which ensure that a bucket having a carrier device 5 placed thereon is not deformed when it is pushed radially inwards in the lateral direction.

When a mop is being pushed into the contraction device 1, a stop is preferably reached after a certain distance of travel. The spring lamellae 6 then produce a restoring force which pushes the mop upwards again. Since the spring lamellae 6 are moved radially inwards when downward pressure is being applied, the spring lamellae 6 push against the contraction lamellae 4. In this respect, the spring lamellae 6 carry the contraction lamellae 4 therewith and move said contraction lamellae radially inwards as well. At the same time, the contraction lamellae 4 carry therewith the guide cams 9 in the guides 10, and this results in a high degree of rotation with little travel. This results in a high degree of rotation over a short distance of travel. A short distance of travel measuring 10 cm brings about a rotation through 30°. In this respect, a spring lamella 6 performs a dual function, namely a wringing-out function and a restoring function. The spring lamellae 6 provide for a relatively large angle of rotation since said spring lamellae 6 promote the restoring action. The guides 10 or the grooves 11 can therefore be relatively flat and not particularly deep in the axial direction.

Figure 11:
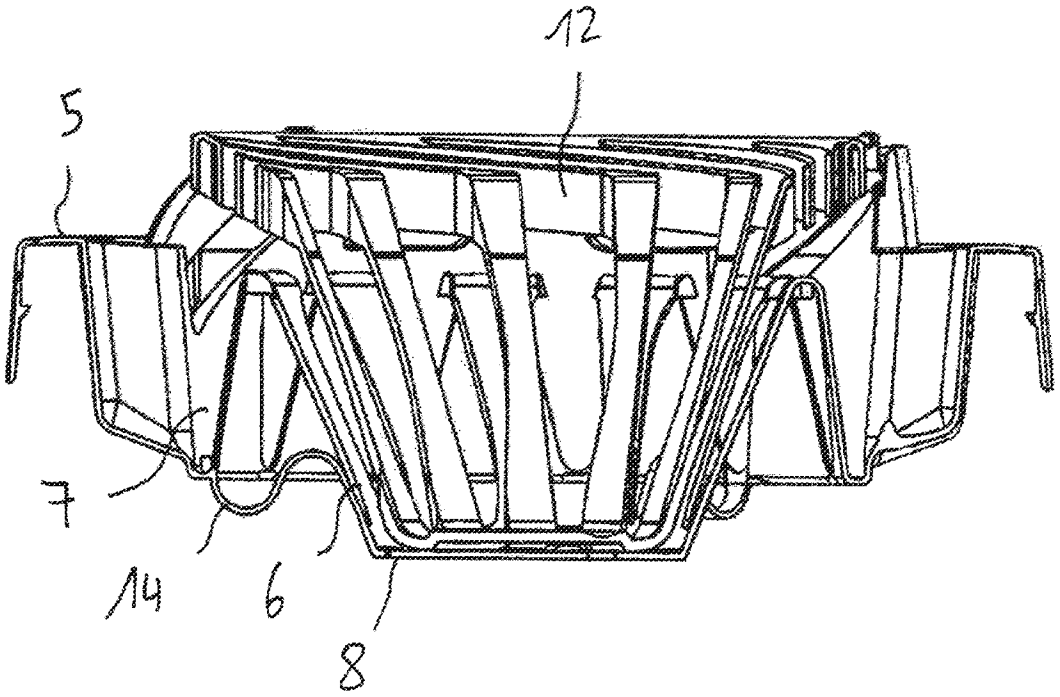
FIG. 11 is a partial cut-out view of a torsion wringer in which torsion cables are provided.
Figure 12:
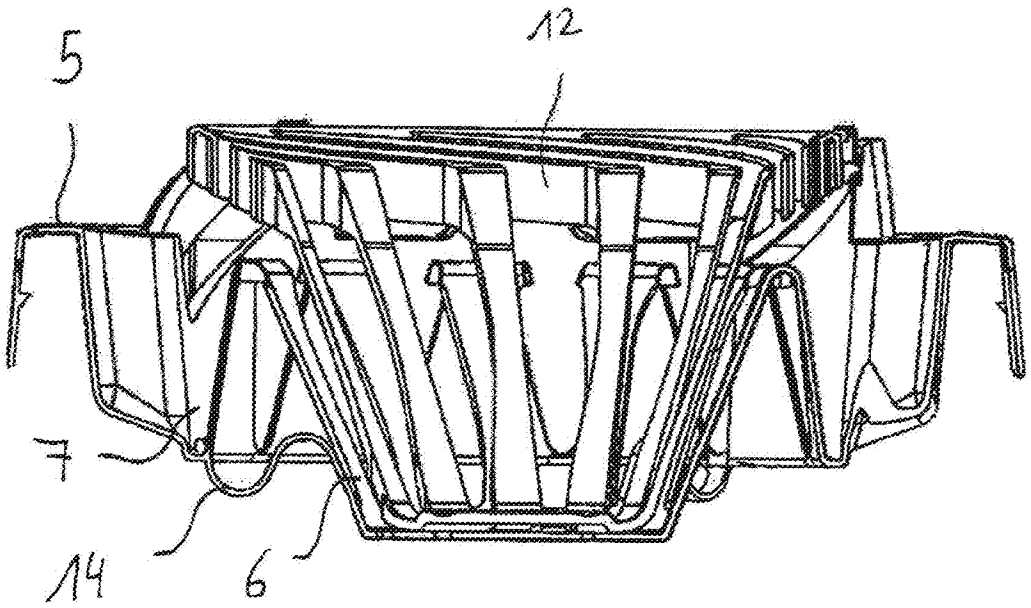
FIG. 12 is another view of the torsion wringer according to FIG. 11.

FIGS. 11 and 12 show another embodiment of a torsion wringer, in which a traction cable 14 is provided which is fastened at one end to a spring lamella 6 and at the other end to a collar 7 of the carrier device 5.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A torsion wringer comprising:

a contraction device configured to receive a mop head of a mop, the contraction device having an upper part and a lower base which are interconnected by contraction lamellae, the contraction lamellae being hinged to the upper part and to the lower base such that the upper part can rotate relative to the lower base, the contraction device being movable relative to a carrier device over a distance of travel, as a result of which the upper part rotates through an angle of rotation relative to the carrier device and relative to the lower base, wherein a reduction unit is provided so as to reduce a force which counteracts the rotation of the upper part.

2. The torsion wringer according to claim 1, wherein the distance of travel is in the range of from 1 cm to 20 cm, and the angle of rotation is in the range of from 5° to 180°.

3. The torsion wringer according to claim 2, wherein the distance of travel is in the range of from 3 cm to 8 cm.

4. The torsion wringer according to claim 3, wherein the distance of travel is in the range of from 3 cm to 5 cm.

5. The torsion wringer according to claim 1, wherein the reduction unit comprises at least one spring element which is operatively connected to the contraction device such that said element is configured to push the contraction device into its starting position counter to the reciprocating force.

6. The torsion wringer according to claim 1, wherein the reduction unit comprises spring lamellae arranged on the carrier device, which spring lamellae are configured to push the contraction lamellae radially inwards when the contraction device is moved relative to the carrier device.

7. The torsion wringer according to claim 6, wherein at least one spring lamella of the spring lamellae has a first leg which is hinged to a collar of the carrier device, and a second leg hinged to a support base of the carrier device.

8. The torsion wringer according to claim 6, wherein at least one spring lamella of the spring lamellae comprises at least one stop lug.

9. The torsion wringer according to claim 6, further comprising a traction cable which is fastened at one end to a spring lamella of the spring lamellae or a support base and at its other end to a collar of the carrier device.

10. The torsion wringer according to claim 1, wherein the contraction lamellae extend from the upper part of the contraction device to the lower base of the contraction device, the lower base remaining rotationally fixed when the upper part is moved relative to the carrier device.

11. The torsion wringer according to claim 1, wherein the contraction lamellae are arranged so as to be inclined with respect to the lower base of the contraction device, the contraction lamellae being configured to bend radially inwards in regions when the upper part is moved relative to the carrier device.

12. The torsion wringer according to claim 1, wherein the lower base of the contraction device is configured to be locked into a spring-mounted support base of the carrier device.

13. The torsion wringer according to claim 1, wherein a mounting device is provided on the carrier device, the mounting device being configured to stably mount a handle of the mop.

14. The torsion wringer according to claim 1, wherein support elements configured to prevent deformation of a bucket are arranged on the carrier device.

15. A set comprising a torsion wringer and a bucket;

the torsion wringer comprising:

a contraction device configured to receive a mop head of a mop, the contraction device having an upper part and a lower base which are interconnected by contraction lamellae, the contraction lamellae being hinged to the upper part and to the lower base such that the upper part can rotate relative to the lower base, the contraction device being movable relative to a carrier device over a distance of travel, as a result of which the upper part rotates through an angle of rotation relative to the carrier device and relative to the lower base, wherein a reduction unit is provided so as to reduce a force which counteracts the rotation of the upper part;

wherein the torsion wringer is interlockingly connected to the bucket.

16. A torsion wringer comprising:

a contraction device configured to receive a mop head of a mop, the contraction device having an upper part and a lower base which are interconnected by contraction lamellae, the contraction lamellae being hinged to the upper part and to the lower base such that the upper part can rotate relative to the lower base, the contraction device being movable relative to a carrier device over a distance of travel, as a result of which the upper part rotates through an angle of rotation relative to the carrier device and relative to the lower base, wherein a reduction unit is provided so as to reduce a force which counteracts the rotation of the upper part, and wherein the contraction device comprises on the upper part thereof guide cams which are in engagement with guides which are associated with the carrier device.

17. The torsion wringer according to claim 16, wherein a guide comprises a curved or inclined groove in which a guide cam is configured to be guided.

18. The torsion wringer according to claim 17, wherein the groove is inclined with respect to the horizontal by a slot angle which is in the range of from 20° to 89°.

19. A torsion wringer comprising:

a contraction device configured to receive a mop head of a mop, the contraction device having an upper part and a lower base which are interconnected by contraction lamellae, the contraction lamellae being hinged to the upper part and to the lower base such that the upper part can rotate relative to the lower base, the contraction device being movable relative to a carrier device over a distance of travel, as a result of which the upper part rotates through an angle of rotation relative to the carrier device and relative to the lower base, wherein a reduction unit is provided so as to reduce a force which counteracts the rotation of the upper part, and wherein the contraction lamellae extend from the upper part of the contraction device to the lower base of the contraction device, a contraction lamella of the contraction lamellae being hinged to the upper part by a pivot element, and the pivot element being configured to bend radially inwards when the upper part is moved relative to the carrier device and relative to the lower base.

20. The torsion wringer according to claim 19, wherein the pivot element comprises a curved portion with a circular segment shape.

* * * * *